United States Patent [19]
Austin

[11] 4,260,092
[45] Apr. 7, 1981

[54] SAFETY ASSEMBLY FOR A TOOL FOR DRIVING FASTENERS

[75] Inventor: Ronald Austin, Hazelcrest, Ill.

[73] Assignee: Duo-Fast Corporation, Franklin Park, Ill.

[21] Appl. No.: 53,956

[22] Filed: Jul. 2, 1979

[51] Int. Cl.[3] ..... B25C 1/04
[52] U.S. Cl. ..... 227/8
[58] Field of Search ..... 173/13; 227/8

[56] References Cited

U.S. PATENT DOCUMENTS

| | | | |
|---|---|---|---|
| 2,498,503 | 2/1950 | Papalia | 227/137 |
| 3,011,169 | 12/1961 | Cast et al. | 227/8 |
| 3,194,324 | 7/1965 | Langas | 173/2 |
| 3,464,614 | 9/1969 | Volkmann | 227/130 |
| 3,612,379 | 10/1971 | Panock | 227/8 |
| 3,784,077 | 1/1974 | Burke, Jr. et al. | 227/8 |

*Primary Examiner*—John McQuade
*Attorney, Agent, or Firm*—Mason, Kolehmainen, Rathburn & Wyss

[57] ABSTRACT

A tool for driving fasteners includes a driver and a device for actuating the driver through a driving stroke. The tool is operated by a trigger assembly that includes a manually actuated trigger pivotally mounted on the tool and a lever pivotally mounted at a first end to the trigger. Also included on the tool is a safety assembly that before the tool can be fired must be actuated prior to actuation of the trigger. The safety mechanism includes a push rod slideably mounted within the tool with a first end engaging a safety yoke and a second end adjacent the lever of the trigger assembly. The safety yoke is slideably mounted on the nose of the tool and is adapted to extend below the nose of the tool to engage the workpiece upon placement of the tool onto the workpiece. As the tool is placed against a workpiece prior to actuation of the trigger, the yoke and, thus, the push rod are moved upwardly until the second end of the push rod engages the lever placing the trigger assembly in an operative mode. As the trigger is thereafter actuated, the lever is pivoted to actuate the tool and drive a fastener. The safety assembly includes an engagement or locking element on the second end of the rod that locks the second end of the lever in an inoperative position if the trigger is actuated prior to the placement of the tool onto the workpiece.

18 Claims, 6 Drawing Figures

SAFETY ASSEMBLY FOR A TOOL FOR DRIVING FASTENERS

BACKGROUND OF THE INVENTION

A. Field of the Invention

The present invention relates to a new and improved safety assembly and related trigger assembly for a tool employed for driving fasteners.

B. Description of the Prior Art

In prior art tools employed for driving fasteners safety mechanisms are often included to prevent firing of the tool until the proper sequence of deactivating the safety mechanism and actuating the tool is performed. Examples of such prior art tools are disclosed in U.S. Pat. No. Re. 29,527 and U.S. Pat. No. 3,784,077.

In prior art fastener driving tools it is desirable in some situations to avoid trip firing wherein the trigger is held in the operative mode and the tool is lifted from and returned onto the workpiece thereby repeatedly firing the tool. Trip firing can be circumvented, if desired, by requiring the safety mechanism and related trigger assembly to be operated in a specific sequence before each fastener is driven into a workpiece. For example, a preferred sequence is that the tool be positioned on the workpiece to deactivate the safety mechanism and thereafter the trigger is actuated to drive a fastener. In this sequence, if the tool is again placed onto the workpiece, the tool is not fired unless the trigger is released and reactuated.

SUMMARY OF THE INVENTION

An object of the present invention is to provide a new and improved tool for driving fasteners.

Another object of the present invention is to provide a new and improved safety mechanism and associated trigger assembly for a tool for driving fasteners into a workpiece.

A further object of the present invention is to provide a new and improved safety mechanism and associated trigger assembly that require the sequence of placing the tool onto a workpiece followed by actuation of the trigger in order to drive a fastener into the workpiece.

The present invention is directed to a new and improved fastener driving tool that includes a driver for driving fasteners into a workpiece and an associated actuating assembly for powering the driver through a driving stroke. The tool further includes a trigger assembly for operating the actuating assembly. The trigger assembly includes a trigger member pivotally mounted on the housing of the tool and a lever that at a first end is pivotally mounted on the trigger. As the lever is pivoted from a first inoperative position to a second operative position, it engages the actuating assembly. If the trigger is thereafter pivoted, the lever actuates the actuating assembly to commence a driving stroke.

A safety assembly is also provided on the tool and includes a push rod slideably mounted within the tool with a first end engaging a safety yoke adapted for engagement with the workpiece. The push rod includes a second end that is spaced from the trigger lever and movable to engagement therewith upon engagement of the safety yoke with the workpiece.

In the proper sequence of actuation, upon engagement of the safety yoke with the workpiece, the yoke and the push rod are moved upwardly and the second end of the push rod engages the lever pivoting it about the trigger into engagement with the actuating member of the tool. Thereafter, the trigger may be actuated, moving the lever and the actuating member to fire the tool.

If, however, the trigger is actuated prior to placement of the tool onto the workpiece, the lever pivots with the trigger but does not engage the actuating member. Thereafter, if the tool is placed into engagement with the workpiece, a locking element defined on the push rod engages the lever and locks the lever so as to prevent further movement of the push rod or the lever. As a result, the tool is not fired.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF THE PREFERRED EMBODIMENT

Figure 1:
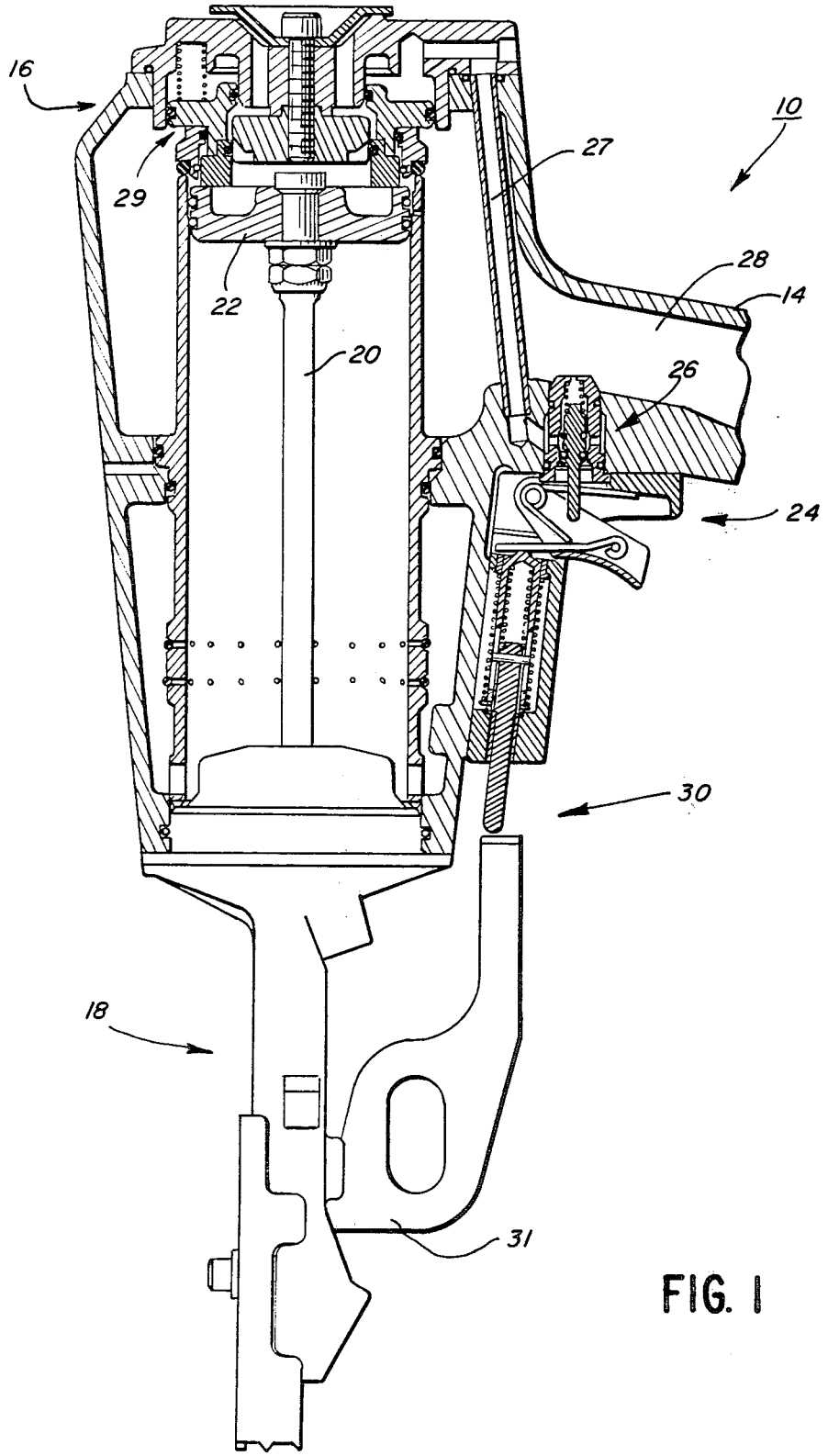
FIG. 1 is a view of a tool including the safety assembly and related associated trigger assembly of the present invention.

Having reference to the drawings and initially to FIG. 1 there is illustrated a tool for driving fasteners generally designated by the reference numeral 10. The tool 10 will only be generally described since it may be one of several different types well known in the art. The tool 10 illustrated is pneumatic and includes a magazine assembly (not shown) for supplying fasteners to be driven by the tool 10. In addition, the tool 10 includes a handle portion 14 intended to be gripped by the operator.

The tool 10 also includes a forward portion generally designated by the reference numeral 16 with a lower nose portion generally designated by the reference numeral 18. The lower end of the nose portion 18 is adapted to be placed on top of a workpiece into which fasteners are to be driven.

Fasteners are driven by a driver 20 that has a piston 22 attached to the upper end thereof. To actuate the driver 20 through a driving stroke, a trigger generally designated by the reference numeral 24 is employed. The trigger 24 operates to actuate, in the embodiment illustrated, an actuating valve 26 that controls the introduction of fluid at atmospheric pressure through a conduit 27 to a location above a poppet assembly 29. This allows pressurized fluid from the reservoir 28 to lift the poppet assembly 29 and act on the piston 22 to drive the driver 20.

To provide safe operation of the tool 10, a safety assembly generally designated by the reference numeral 30 is provided. The safety assembly 30 operates in conjunction with the trigger assembly 24 to require a sequence of steps before the tool 10 may be fired.

More specifically, in order to drive a fastener, the tool 10 must be placed with the nose portion 18 against a workpiece, this causes a safety yoke 31 that is slideably mounted on the nose portion 18 to engage the workpiece and slide upwardly, thereby actuating the safety assembly 30. The trigger assembly 24 may then be actuated to power the driver 20 through a fastener driving stroke. If this sequence of steps is not followed, such as for example, if the trigger 24 is actuated prior to the safety assembly 30, the tool 10 cannot be fired.

Figure 2:
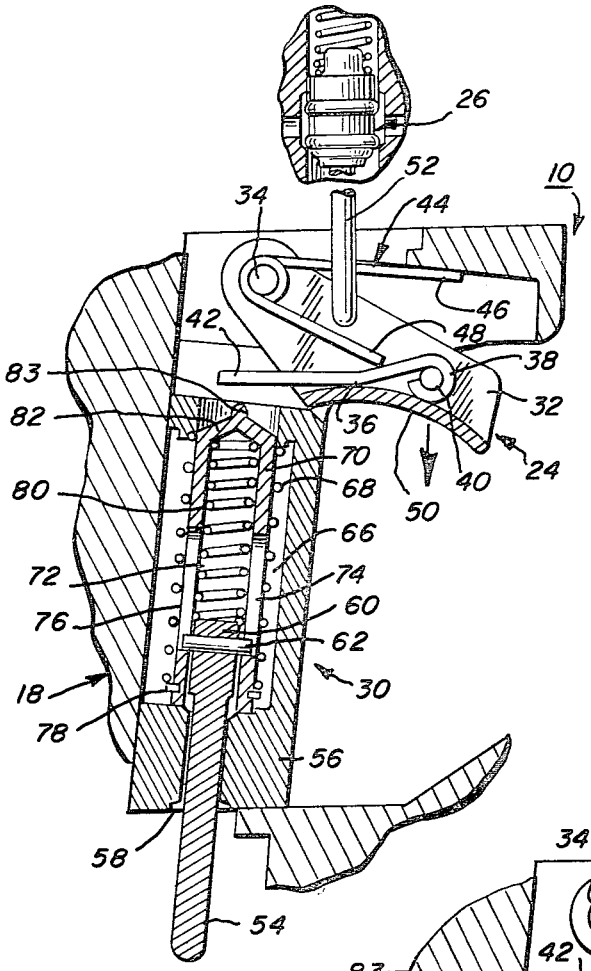
FIG. 2 is a view of the safety and trigger assemblies in the normal or static position of the tool.

For specific consideration of the structure of the safety assembly 30 and its interaction with the trigger assembly 24, reference is now made to FIGS. 2–6. FIG. 2 illustrates the safety 30 and trigger 24 assemblies in the static or normal position wherein the tool 10 has not been placed on the workpiece nor has the trigger assembly 24 been actuated. With specific reference to the trigger assembly 24, this assembly includes a trigger member 32 pivotally mounted to the tool 10 by a pin 34 to allow actuation by a finger of the operator. Pivotally mounted within the trigger member 32 is a lever 36 including a first end 38 that surrounds a pin 40 secured to the trigger member 32. The lever 36 also includes a second end 42 extending away from the pin 40. A resilient spring 44 is wrapped around the pin 34 with a first end 46 engaging the tool 10 and a second end 48 engaging the lever 36 so as to resiliently bias the trigger member 32 to a downward position and also to bias the lever 36 into abutting engagement with a flange 50 defined on the trigger member 32.

It is intended for the trigger assembly 24 to actuate valve 26 when the proper sequence of steps is followed. Actuation of the valve 26 by the trigger member 32 is accomplished through the employment of a downward extending pin 52 that is integrally defined on the valve member 26. In the downward position of the valve 26 illustrated in FIG. 2, atmospheric pressure is not communicated to the poppet assembly 29 such that the tool 10 remains in the static or normal position. Upward movement of the pin 52, however, displaces the valve 26 to a position allowing communication of atmospheric pressure to the poppet assembly 29 by way of the conduit 27. Upward movement of the pin 52 is accomplished through the engagement of the pin 52 with the lever 36 after the proper sequence of actuation of the safety assembly 30 and the trigger assembly 24 has been followed.

Considering now the safety assembly 30, this assembly includes a push rod 54 that extends downwardly to engage the safety yoke 31 as illustrated in FIG. 1. The push rod 54 is slideably mounted on the tool and extends through a bore 58 defined within a safety assembly housing 56. The upper end 60 of the push rod 54 includes a pin 62 positioned within a bore or cavity 72 defined in the sleeve 70. A spring 68 is mounted within the bore 66 and at one end engages the upper end of the safety assembly housing 56.

Mounted on and surrounding the upper end 60 of the push rod is a cap or sleeve member 70 that has an internal bore 72 into which is positioned the upper end 60 of the push rod 54. Also defined in the cap member 70 are slots 74 and 76 through which extend the retainer pin 62. The interaction of the pin 62 in the slots 74 and 76 serves as a guide as the rod 54 and specifically the end 60 slides within the sleeve member 70. In addition, the spring 68 engages a lower snap ring 78 mounted on the cap 70 and serves to bias the cap member 70 to a downward position into engagement with bottom end of the bore 66.

A second spring 80 that is of a smaller diameter than the spring 68 but of a greater stiffness is mounted within the bore 72 and engages the upper end 82 of the cap member at one end and the upper end 60 of the push rod 54 at the other end. Spring 80 serves to bias the push rod 54 downwardly toward the yoke 31 of the tool 10 and with the spring 68 provides a lost motion function More specifically, engagement of the yoke 31 with the workpiece moves the push rod 54 and the cap 70 compressing the spring 68. The spring 68 is compressed until sufficient force is developed to overcome the bias of spring 80. This coincides with engagement of the cap 70 with the lever 36 and movement of the lever 36 to engagement with the pin 34. Thereafter, spring 80 is also compressed as the push rod 54 moves upwardly until the tool 10 is fully placed on the workpiece. Accordingly, the yoke 31 and push rod 54 move a predetermined distance after full movement of the cap 70 thereby providing the lost motion feature. This lost motion ensures that recoil of the tool 10 upon firing does not result in refiring the tool 10 since the tool 10 may lift slightly from the workpiece wherein the rod 54 moves downwardly within the cap 70 but since the force in the compressed spring 80 is still greater than that in the compressed spring 68, the cap 70 does not move away from the lever 36. In addition, the springs 68 and 80 ensures that the yoke 31 is always in the down position.

Having described the structure of the safety 30 and trigger 24 assemblies of the present invention, the proper and improper operation will now be set forth. The preferred sequence of operation is that prior to actuation of the trigger 24, the tool 10 be placed against a workpiece in which a fastener is to be driven. If the trigger 24 is actuated prior to the placement of the tool 10 against a workpiece, however, the following is accomplished.

Figure 3:
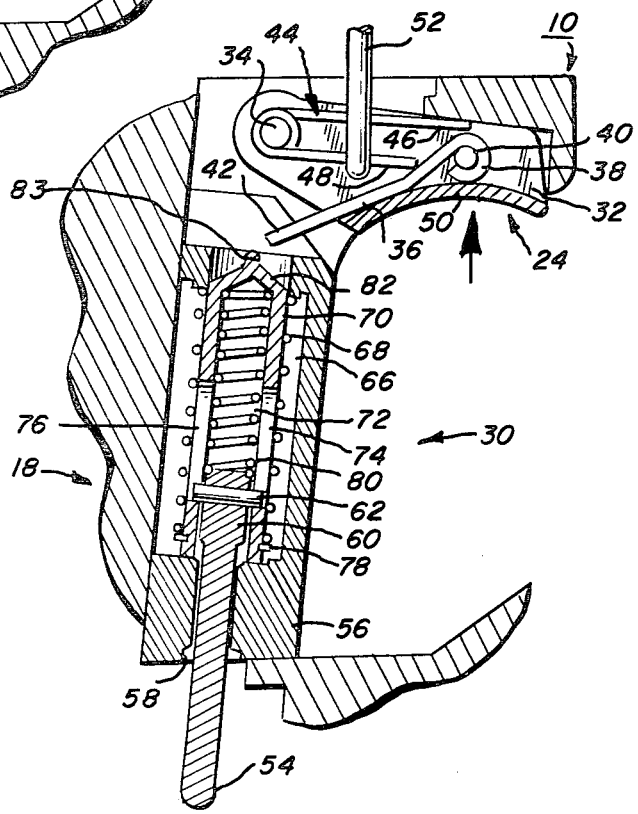
FIG. 3 is a view of the safety and trigger assemblies wherein the trigger has been actuated prior to actuation of the safety assembly.

FIG. 3 illustrates actuation of the trigger 24 prior to placement of the tool 10 against a workpiece. If this sequence of steps is followed, the trigger member 32 is pivoted about the pin 34 to the position illustrated in FIG. 3. As this occurs the spring 44 biases the lever 36 to a position against the flange 50 such that the end 42 of the lever 36 extends downwardly and slightly spaced from the end 82 of the cap member 70. The end 82 includes an abuttment member or nipple 83 that in the position illustrated in FIG. 3 is slightly spaced from the end 42 of the lever 36.

Figure 4:
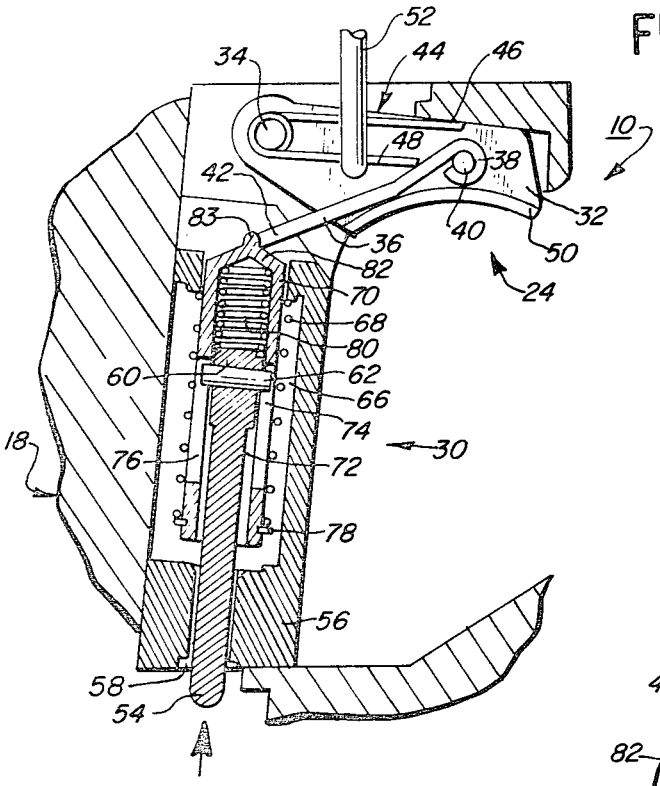
FIG. 4 is a view of the trigger and safety assemblies wherein the tool has been placed on a workpiece after the trigger has been actuated.

If the tool 10 is thereafter placed on a workpiece the lower end of the yoke 31 engages the workpiece and moves the rod 54 upwardly within the housing 56 to the position best illustrated in FIG. 4. As this occurs, the spring 68 is compressed initially until sufficient force is developed whereupon the cap member 70 moves with the push rod 54 upwardly further compressing the spring 68. This movement continues until the abuttment member or nipple 83 engages the end 42 of the lever 36. As this engagement occurs (FIG. 4), the orientation of the lever 36 is such that the cap 70 is locked in position and further upward movement of the cap member 70 is prevented. Continued movement of the push rod 54, however, is possible through compression of the spring 80 until abuttment of the retaining pin 62 with the upper ends of the slots 74 and 76. Engagement of the retaining pin 62 with the upper ends of the slots 74 and 76 coincides with the engagement of the lower end of the nose portion 18 with the workpiece such that further movement of the push rod 54 is no longer possible.

At the completion of this second step of placing the tool 10 against the workpiece, the trigger 24 and safety 30 assemblies are in the positions illustrated in FIG. 4 wherein the trigger member 32 is fully pivoted about the pin 34 but the lever 36 is spaced from the pin 52 so that actuation of the tool 10 is not possible. Consequently, the tool 10 is not fired following this sequence.

Figure 5:
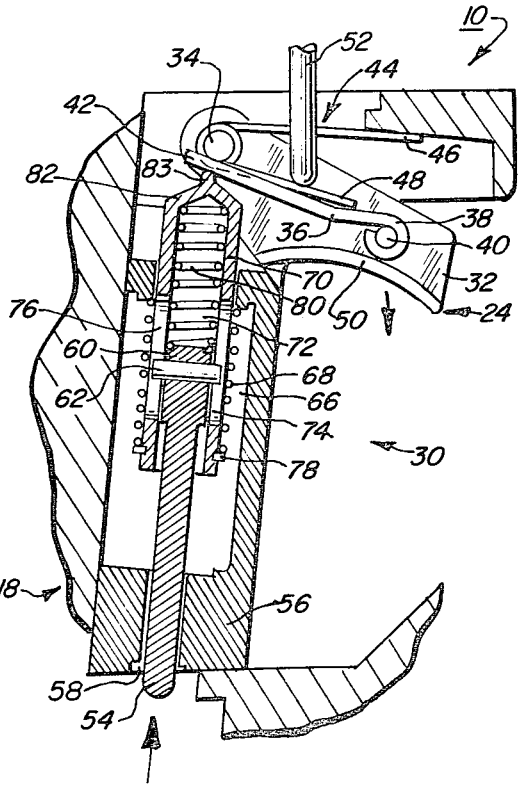
FIG. 5 is a view of the trigger and safety assemblies with the tool positioned on a workpiece prior to actuation of the trigger assembly; and, FIG. 6 is a view of the safety and trigger assemblies in the position wherein the safety assembly has been actuated followed by actuation of the trigger assembly resulting in actuation of the tool to drive a fastener into a workpiece.
Figure 6:
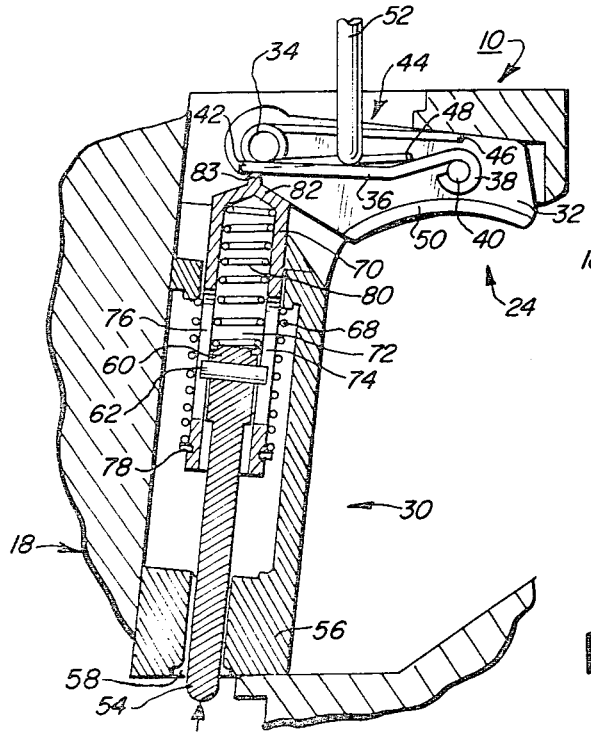

FIGS. 5 and 6 illustrate the proper sequence of actuation of the trigger 24 and safety 30 assemblies. More specifically, as illustrated in FIG. 5, the tool 10 is placed against a workpiece moving the yoke 31 and the push rod 54 upwardly. At this occurs the cap member 70 is also moved upwardly under the influence of the springs 68 and 80.

Once the tool 10 is completely placed against the workpiece, the cap member 70 and push rod 54 are in the positions illustrated in FIG. 5 wherein the engagement member 83 has engaged the under surface of the lever 36 and pivoted the lever 36 about the pin 40 to engagement with the pin 34. In this position, the lever 36 is adjacent to and slightly touching the pin 52. Thereafter the trigger 24 may be actuated by pivoting it about the pin 34 causing upward movement of the lever 36 as illustrated in FIG. 6. As the lever 36 is moved upward, the pin 52 is also moved upwardly causing upward displacement of the valve 26, communicating atmospheric pressure through the conduit 27 to the poppet assembly 29 firing the tool 10.

Once a fastener has been driven and the tool is lifted off the workpiece, the safety assembly 30 returns to the position illustrated in FIG. 3, but if the trigger member 32 is not returned to its normal position and the tool 10 is again placed on a workpiece, the safety assembly 30 will move in accordance with the positions illustrated in FIGS. 3 and 4 thus preventing firing of the tool. Accordingly, not only must the tool 10 be removed from the workpiece, but in addition, the trigger assembly 24 must be released to allow it to return to its normal position under the influence of the spring 44 before the tool 10 can again be fired.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. In a fastener driving tool of the type including a driver for driving fasteners into a workpiece and means for actuating said driver, the improvement comprising:

a trigger assembly for operating said actuating means, said trigger assembly including a trigger member pivotally mounted on said tool, a trip lever pivotally mounted on said trigger member, and a safety assembly for actuating said trigger assembly into an operative position, said safety assembly including a push rod assembly slideably mounted in said tool, said push rod assembly including a push rod with a first end and a second end, said second end adapted to engage said workpiece upon placement of said tool on said workpiece, said first end including means for engaging said lever and preventing pivoting thereof when said trigger member is actuated and said tool is placed on said workpiece.

2. The tool claimed in claim 1 wherein said trigger assembly further comprises a trigger pin slideably mounted in said tool with a first end adjacent to said lever and a second end adjacent to said actuating means whereby said pin engages and operates said actuating means upon movement of said pin by said lever when said trigger member is in an operative position.

3. The tool claimed in claim 1 wherein said lever includes a first end pivotally connected to said trigger member and a second end extending toward and over said push rod assembly prior to actuation of said trigger member for pivoting said lever, and extending toward said engaging means for engagement with said first end of said push rod assembly when said trigger member is actuated prior to contact of said safety assembly with said workpiece.

4. The tool claimed in claim 1 wherein said push rod is slideably mounted in said tool, a sleeve slideably mounted on said first end, first means for biasing said push rod toward said workpiece and second means for biasing said sleeve toward said lever.

5. The tool claimed in claim 4 wherein said sleeve includes an engagement member for engaging said lever to prevent pivoting of said lever and further movement of said push rod assembly when said trigger member is actuated followed by engagement of said safety assembly with said workpiece.

6. A safety for a fastener driving tool wherein said tool includes a driver for driving fasteners into a workpiece and means for actuating said driver through a driving stroke, said safety comprising, a push rod assembly including a push rod slideably mounted in said tool, a safety yoke slideably mounted on said tool and engaging said push rod, said safety yoke extending below said tool to engage a workpiece upon placement of said tool on said workpiece, a trigger pivotally mounted on said tool, a lever including a first end pivotally mounted on said trigger and a second end extending over said push rod in the unactuated position of said trigger, said second end of said lever aligned with said rod to engage said rod to prevent movement of said rod upon said trigger being actuated followed by placement of said tool on said workpiece.

7. The safety set forth in claim 6 wherein said push rod includes a first end for engagement with said yoke, and a sleeve mounted on a second end of said push rod.

8. The safety set forth in claim 7 wherein said sleeve includes abuttment means for engaging said second end of said lever to prevent further movement thereof upon said trigger being actuated followed by said tool being placed on said workpiece, and for engaging and pivoting said lever upon said tool being placed on said workpiece followed by actuation of said trigger.

9. The safety set forth in claim 7 wherein said sleeve is slideably mounted on said push rod, first biasing means for biasing said rod toward a lower portion of said tool and second biasing means for biasing said sleeve toward said lever.

10. The safety set forth in claim 6 further comprising means for biasing said lever toward said push rod.

11. The safety set forth in claim 6 wherein said actuating means is adjacent said lever and is actuated by said lever as said lever is pivoted by said trigger after said tool has been placed on said workpiece.

12. A safety assembly for a fastener driving tool including a driver for driving said fasteners, and means for actuating said driver, said safety assembly comprising:

a push rod slideably mounted on said tool, said push rod including first and second ends, said second end including means for engaging a workpiece upon placement of said tool on said workpiece, a trigger mounted on said tool, a lever pivotally mounted on said trigger, a cap member slideably mounted on said first end of said push rod, said cap member including an abuttment member defined thereon for abutting said lever to prevent pivoting of said lever upon actuation of said trigger followed by engagement of said tool with said workpiece and for pivoting said lever adjacent said actuating means upon engagement of said tool with said workpiece followed by actuation of said trigger, whereupon said tool may be fired upon actuation of said trigger.

13. The safety assembly claimed in claim 12 further comprising first biasing means for biasing said push rod toward said workpiece and second biasing means for biasing said cap member toward said lever.

14. The safety assembly claimed in claim 12 further comprising a spring mounted on said tool and engaging said lever to bias said lever toward said cap member.

15. In a fastener driving tool for driving fasteners into a workpiece, the improvement comprising a trigger assembly movable from an inoperative position to an operative position to control operation of the tool, a workpiece responsive assembly movable from an inoperative position to an operative position as the tool is moved adjacent the workpiece, and a safety control assembly coupling the trigger and workpiece responsive assemblies and (1) responsive to movement of both the trigger and workpiece responsive assemblies to their operative positions for effecting operation of the tool to drive a fastener, and (2) responsive to movement of the trigger assembly to its operative position prior to the movement of the workpiece responsive assembly to its operative position for mechanically preventing movement of the workpiece responsive assembly to its operative position.

16. The tool claimed in claim 15 wherein said safety control assembly includes a rod slideably mounted on said tool, said rod including means for engaging said workpiece responsive assembly.

17. The tool claimed in claim 16 further comprising a cap mounted on said rod and engaging said trigger assembly.

18. The tool claimed in claim 15 wherein said trigger assembly includes a trigger member pivotally mounted on said tool and a lever pivotally mounted on said trigger member.

* * * * *